US010434785B2

(12) United States Patent
Bingham et al.

(10) Patent No.: US 10,434,785 B2
(45) Date of Patent: Oct. 8, 2019

(54) FLUID SUPPLY ASSEMBLY

(71) Applicant: Hewlett-Packard Development Company, L.P., Houston, TX (US)

(72) Inventors: Jeffrey G Bingham, Vancouver, WA (US); Sam Sing, Vancouver, WA (US); Justin M Roman, Portland, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,553

(22) PCT Filed: Jan. 27, 2016

(86) PCT No.: PCT/US2016/015217
§ 371 (c)(1),
(2) Date: Mar. 27, 2018

(87) PCT Pub. No.: WO2017/131678
PCT Pub. Date: Aug. 3, 2017

(65) Prior Publication Data

US 2018/0264831 A1 Sep. 20, 2018

(51) Int. Cl.
*B41J 2/175* (2006.01)

(52) U.S. Cl.
CPC ..... *B41J 2/17523* (2013.01); *B41J 2/175* (2013.01); *B41J 2/1752* (2013.01); *B41J 2/17509* (2013.01)

(58) Field of Classification Search
CPC ..... B41J 2/1752; B41J 2/17523; B41J 2/175; B41J 15/06; B41J 15/08; B41J 15/10; B41J 15/12; B41J 15/14; B41J 25/34; B41J 33/04
See application file for complete search history.

(56) References Cited

U.S. PATENT DOCUMENTS

| | | | |
|---|---|---|---|
| 6,206,511 | B1 | 3/2001 | Cook et al. |
| 6,293,649 | B1 | 9/2001 | Norton |
| 6,481,838 | B1 | 11/2002 | Brugue et al. |
| 6,511,165 | B1 | 1/2003 | Barinaga et al. |
| 6,623,105 | B1 | 9/2003 | Shen |
| 7,210,771 | B2 | 5/2007 | Neese et al. |
| 2002/0047881 | A1 | 4/2002 | Lewis et al. |
| 2003/0076391 | A1 | 4/2003 | Wilson et al. |

(Continued)

FOREIGN PATENT DOCUMENTS

| | | |
|---|---|---|
| CN | 102381039 | 3/2012 |
| CN | 104507688 | 4/2015 |

(Continued)

OTHER PUBLICATIONS

Webpage. CISS Technology Can Reduce Your Per Paper Printing Cost. Aug. 10, 2013.

*Primary Examiner* — Scott A Richmond
(74) *Attorney, Agent, or Firm* — Dierker & Kavanaugh PC

(57) ABSTRACT

In an example implementation, a fluid supply assembly includes a printhead assembly and a carriage comprising a quick-release, hand-operable attachment mechanism to removably attach the printhead assembly to the carriage. A fluid conduit interconnect is rigidly attached to the printhead assembly by a tool-operable fastener. The fluid conduit interconnect is to connect to a fluid conduit to communicate printing fluid from an off-axis printing fluid supply to the printhead assembly.

20 Claims, 6 Drawing Sheets

(56) References Cited

U.S. PATENT DOCUMENTS

| | | | | |
|---|---|---|---|---|
| 2003/0113729 | A1 | 6/2003 | Daquino et al. | |
| 2005/0093922 | A1 | 5/2005 | McGarry | |
| 2006/0176347 | A1 | 8/2006 | Hong et al. | |
| 2006/0278577 | A1* | 12/2006 | Yamamoto | B41J 2/175<br>210/512.1 |
| 2011/0254902 | A1 | 10/2011 | Kieser et al. | |
| 2012/0050420 | A1* | 3/2012 | Sekino | B41J 2/17509<br>347/85 |
| 2012/0268534 | A1 | 10/2012 | Gomez et al. | |
| 2015/0217585 | A1* | 8/2015 | Suzuki | B41J 2/17509<br>347/39 |
| 2017/0120618 | A1* | 5/2017 | Nakamura | B41J 2/17523 |

FOREIGN PATENT DOCUMENTS

| | | |
|---|---|---|
| EP | 1527886 | 5/2005 |
| JP | 2015-215006 | * 10/2015 |
| WO | WO-2013158093 | 10/2013 |

* cited by examiner

FLUID SUPPLY ASSEMBLY

BACKGROUND

Printing systems are a type of fluid dispensing system that can be used to print images and/or text onto a print medium or print target. Some printing systems can include a moveable carriage to which a printhead assembly is attached. The printhead assembly can deliver printing fluid to a print medium or print target during operation of the printing system. Printing fluid can be supplied to a printhead assembly by an on-axis fluid supply that travels along with the printhead assembly on the moveable carriage, or by an off-axis, stationary fluid supply that supplies fluid to the printhead assembly through a tube or other fluid conduit.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
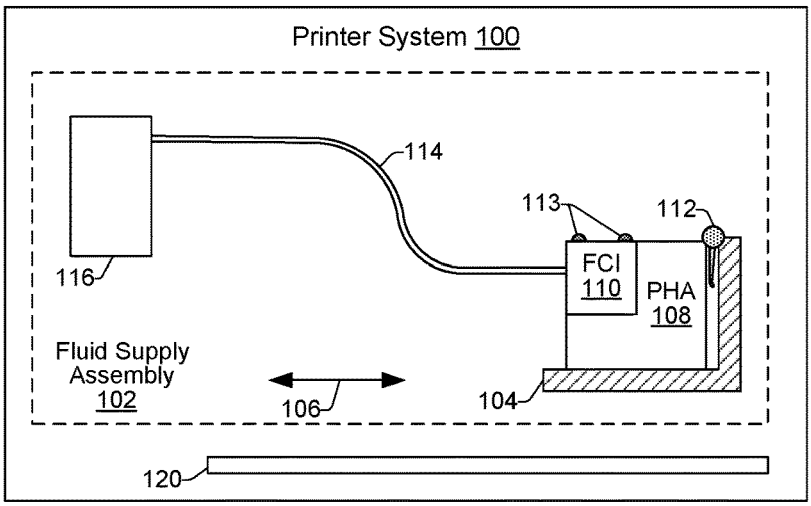
FIG. 1 shows a block diagram of an example printing system in which examples of a fluid supply assembly may be implemented.

Printing systems, such as various inkjet printing systems, can include on-axis and off-axis printing fluid supply systems to facilitate the printing of text and/or images onto print media or other print targets. Some example printing systems can include both on-axis and off-axis fluid supplies, while other example systems can include either on-axis or off-axis fluid supplies. An on-axis printing fluid supply system can include one or multiple printing fluid supplies that are installed on or integrated within a printhead assembly. A printing fluid supply can include a container that holds printing fluid that is to be delivered to the printhead assembly. A printing fluid can include various types of printing fluids, such as different colored inks (e.g., cyan, magenta, yellow, black ink), or other types of printing fluid such as finishing fluids, fusing agents, and so on. Use of the term "ink" herein is intended to generally include various types of printing fluids.

A print medium can include paper, a transparency foil, or any other medium onto which printing fluid can be deposited to form an image and/or text. More generally, a print target can refer to either a two-dimensional (2D) print medium or a three-dimensional (3D) structure on which 3D printing can be performed. Accordingly, although reference is made herein to a "print medium," it is noted that techniques and/or mechanisms presented throughout this disclosure can also be used with a 3D print target such as a bed of print material, for example. Thus, in different examples, a "printing system" may refer to a 2D printing system or a 3D printing system.

A printhead assembly can include one or multiple printing fluid ejectors (e.g., printheads) to eject printing fluid received from the one or multiple printing fluid supplies onto a print target or medium during operation of the printing system. The printhead assembly can be attached to a moveable carriage of the printing system. During operation of the printing system, the moveable carriage of the printing system can move back and forth with respect to the print medium as printing fluid is deposited onto the print medium. With an on-axis fluid printing supply system, the printing fluid supply or supplies installed on or within the printhead assembly move with the carriage.

An off-axis printing supply system includes one or multiple printing fluid supplies that are separated from the printhead assembly. An off-axis printing fluid supply can be attached to another part of the printing system that is remote from the printhead assembly, or it can be attached outside of and away from the printing system. Thus, an off-axis fluid supply remains stationary with respect to the printhead assembly and carriage during operation of the printing system while the printhead assembly and carriage are moved back and forth to print onto a print medium. A print fluid conduit can be used to communicate printing fluid between each respective printing fluid supply and printing fluid ejector within the printhead assembly. A print fluid conduit can include, for example, one or multiple flexible tubes or other types of fluid communication structures.

In some example printing systems, different carriage designs are provided for respective on-axis and off-axis printing fluid supply systems. While an example printing system may have a carriage designed to accommodate an on-axis printing fluid supply system, customers often desire to have an off-axis fluid supply because it provides a larger volume of ink than is available from an on-axis fluid supply. However, a carriage designed for an off-axis printing fluid supply system may be different from a carriage designed for an on-axis printing fluid supply system, since the carriage for the off-axis printing fluid supply system will accommodate fluid conduits (e.g. tubes) from the off-axis printing fluid supplies. Having to reconfigure a carriage designed for an on-axis printing fluid supply system to operate with an off-axis printing fluid supply system can add cost and time delay to the development of printing systems.

Accordingly, examples presented herein of a fluid supply assembly in a printing system provide access to an off-axis printing fluid supply using a carriage that was initially designed for use with an on-axis fluid supply. The fluid supply assembly includes a printhead assembly (PHA) and a fluid conduit interconnect to supply printing fluid from an off-axis supply to the PHA. The fluid conduit interconnect can be connected to a fluid conduit or fluid conduits to provide/communicate printing fluid from the off-axis printing fluid supply through the fluid conduit interconnect to the printhead assembly. Connection of the fluid conduit to the fluid conduit interconnect instead of directly to the printhead assembly enables the printhead assembly to be more easily removed from the printing system for service or replacement.

The printhead assembly is removably attachable to the printing system carriage by a quick-release, hand-operable attachment mechanism of the carriage. In some examples, the attachment mechanism can be part of the printhead assembly. The hand-operable attachment mechanism is operable by a user to attach the printhead assembly to the carriage in a single action or motion. The hand-operable attachment mechanism includes a moveable member such as a lever that can be actuated by a user to attach or detach the printhead assembly.

In contrast to the printhead assembly's removable attachability to the carriage, the fluid conduit interconnect is more rigidly fastened to the printhead assembly in a semi-permanent manner. The rigid attachment of the fluid conduit interconnect to the printhead assembly can be achieved through the use of various tool-operable fasteners, such as threaded screw fasteners. Thus, the attachment and detachment of the fluid conduit interconnect with respect to the printhead assembly is not a hand-operable maneuver readily performed by the user. Rather, a tool is to be used to effect the more rigid and semi-permanent attachment of the fluid conduit interconnect to the printhead assembly.

The rigid attachment of the fluid conduit interconnect to the printhead assembly helps to meet one of the challenges presented when using an off-axis printing fluid supply, which is how to maintain a robust fluidic connection between the off-axis fluid supply and printhead assembly as the printhead assembly is ferried back and forth across the print target by the carriage. In some circumstances a levered attachment mechanism, such as that used in some examples to removably attach the printhead assembly to the carriage, may not be adequate to maintain an attachment between the fluid conduit interconnect and the printhead assembly. For example, stresses applied by the fluid conduit against the fluid conduit interconnect can increase if the printing system is jostled about or dropped, or if the fluid conduit is pulled on. Without a robust attachment between the fluid conduit interconnect and printhead assembly, stresses from the fluid conduit and elsewhere can cause the fluid conduit interconnect to become detached from the printhead assembly. Thus, examples of a fluid supply assembly are presented that include a rigid attachment of a fluid conduit interconnect to a printhead assembly.

In an example implementation, a fluid supply assembly includes a printhead assembly, and a carriage includes a quick-release, hand-operable attachment mechanism to removably attach the printhead assembly to the carriage. A fluid conduit interconnect is rigidly attached to the printhead assembly by a tool-operable fastener. The fluid conduit interconnect is to connect to a fluid conduit to communicate printing fluid from an off-axis printing fluid supply to the printhead assembly.

In another example implementation, a printing system includes an off-axis printing fluid supply and a printhead assembly. A carriage of the printing system includes a hand-operable attachment mechanism moveable between a locked and unlocked position. The locked position is to secure the printhead assembly to the carriage, and the unlocked position is to release the printhead assembly from the carriage. A fluid conduit, which is rigidly attached to the printhead assembly by a threaded fastener, is to provide printing fluid from the off-axis printing fluid supply to the printhead assembly through a fluid conduit.

In another example implementation, a method includes providing a printhead assembly that is removably attachable to a printing system carriage by a hand-operable lever of an attachment mechanism, and providing a fluid conduit interconnect to communicate printing fluid from an off-axis printing fluid supply through a fluid conduit to the printhead assembly. The fluid conduit interconnect is rigidly attached to the printhead assembly by a tool-operable, threaded fastener.

FIG. 1 shows a block diagram of an example printing system 100 in which examples of a fluid supply assembly 102 may be implemented. As shown in FIG. 1, an example fluid supply assembly 102 includes a moveable carriage 104. The carriage 104 can be slidably mounted onto a printing system shaft (not shown) and translated back and forth along the shaft as indicated by the directional arrow 106 in response to communications and/or control signals from a printing system controller (not shown). The carriage 104 is able to receive a printhead assembly (PHA) 108 that can be removably attached to the carriage 104 by a quick-release, hand-operable attachment mechanism 112.

As shown in FIG. 1, a fluid conduit interconnect (FCI) 110 can be attached to the printhead assembly 108 by a fastener or fasteners 113. In some examples, the attachment of the fluid conduit interconnect 110 to the printhead assembly 108 is a rigid attachment that is semi-permanent. The rigid, semi-permanent attachment can be achieved through the use of tool-operable fasteners 113, such as threaded fasteners that are operable by a screwdriver or other suitable torquing mechanism. A rigid or firm attachment between objects such as a fluid conduit interconnect and printhead assembly can be achieved using threaded fasteners, for example, because of the amplification of fastening force created by an application of relatively low torque or rotational force to the fastener. As used herein, a "semi-permanent attachment" is intended to indicate an attachment that is rigidly maintained by a mechanical fastener that is not a hand-operable fastener. Thus, a semi-permanent attachment is not a permanent attachment because a tool can be used to mechanically manipulate the fastener to undo the attachment. However, the mechanical manipulation used to undo the attachment additionally indicates that a semi-permanent attachment is not a removable, quick-release, or hand-operable attachment as generally described herein with regard to the attachment of the printhead assembly to the carriage.

The fluid conduit interconnect 110 can be connected to a printing fluid conduit 114 which in turn can be connected to an off-axis printing fluid supply 116. The fluid conduit interconnect 110 enables printing fluid from the off-axis printing fluid supply 116 to flow to the printhead assembly (PHA) 108 through the fluid conduit 114 and the fluid conduit interconnect 110. In some examples, the printing fluid can flow from the fluid supply 116 to the PHA 108 under the force of gravity. In some examples, the printing system 100 can include a pump to facilitate and/or cause the flow of printing fluid from the off-axis printing fluid supply 116 to the PHA 108. In some examples, the printing system 100 can include multiple off-axis printing fluid supplies 116 that are fluidically coupled to the PHA 108 through multiple fluid conduits 114 and the fluid conduit interconnect 110.

Figure 2:
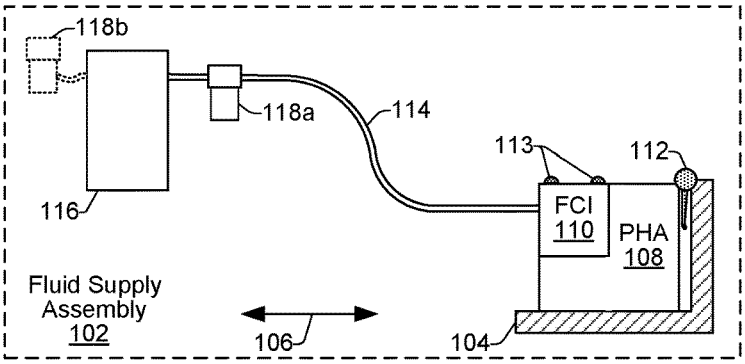
FIG. 2 shows an example fluid supply assembly in which a fluid pump is incorporated to control the flow of printing fluid.

FIG. 2 shows an example fluid supply assembly 102 in which a fluid pump 118 (illustrated as fluid pump 118*a* and fluid pump 118*b*) is incorporated to control the flow of printing fluid from the off-axis printing fluid supply 112 to the PHA 108. A fluid pump 118 can be activated and controlled, for example, by a controller (not shown) of the printing system 100. In different implementations, a fluid pump 118 may be positioned in different locations within the fluid supply assembly 102. For example, as shown in FIG. 2, in one implementation a fluid pump 118*a* can be positioned in-line with the fluid conduit 114. In other examples, a fluid pump 118*b* (illustrated in dashed lines) can be positioned at the off-axis fluid supply 116. A fluid pump 118 can be any suitable type of pump to cause fluid to flow from the off-axis fluid supply 116 through the fluid conduit 114 and fluid conduit interconnect 110 to the printhead assembly 108. Suitable pumps may include, for example, a fluid pump, a pneumatic pump, a pneumatic driven fluid pump, and so on.

Figure 3:
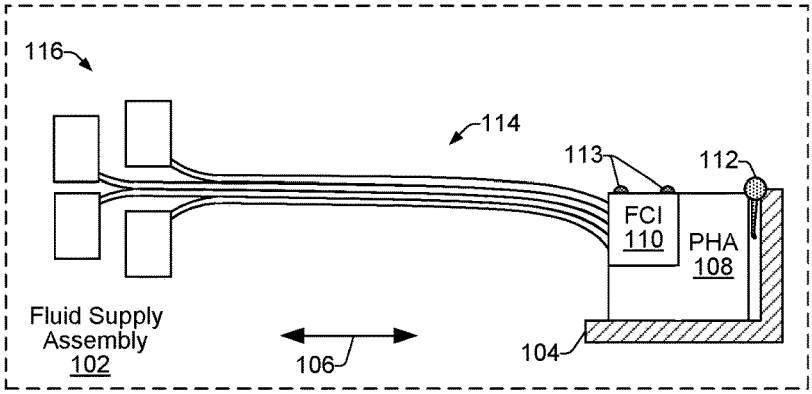
FIG. 3 shows an example fluid supply assembly in which multiple off-axis printing fluid supplies are fluidically coupled to a printhead assembly through a fluid conduit.

FIG. 3 shows an example fluid supply assembly 102 in which multiple off-axis printing fluid supplies 116 are fluidically coupled to the PHA 108 through a fluid conduit 114 and fluid conduit interconnect 110. In examples such as shown in FIG. 3, the fluid conduit 114 can comprise flexible ribbon tubing that includes multiple tubes or fluid paths for interconnecting the printing fluid supplies 116 to the fluid conduit interconnect 110. The fluid conduit/tubing 114 can be made of various materials such as nylon, polyurethane, polyethylene, polypropylene, poly-vinyl chloride, synthetic rubber, natural rubber, polymer, plastic, Teflon, metal, and combinations thereof. The printing fluid supplies 116 can contain various printing fluids, such as different colored inks, finishing fluids, fusing agents, and so on. Although not specifically illustrated in FIG. 3, in some examples the multiple off-axis fluid supplies 116 can be connected to a fluid pump such as the fluid pump 118 shown and discussed with regard to FIG. 2. Such a pump can be connected to the fluid supplies 116 through pressure pipes, for example, and can be activated in a selective manner by a controller (not shown) to pressurize the fluid supplies 116 to cause fluid from a particular supply 116 to flow through a particular tube or fluid pathway to the fluid conduit interconnect 110 and PHA 108.

Referring to FIGS. 1-3, a printing fluid supply 116 can be said to be an "off-axis" printing fluid supply 116 because it is located away from the printing system carriage 104 and remains in a stationary position within the printing system 100 during operation of the printing system 100. In some examples, an off-axis printing fluid supply 116 may be located outside of and away from the printing system 100. Conversely, the PHA 108 can be said to be "on-axis" because of its attachability to the carriage 104, which enables the PHA 108 and rigidly connected fluid conduit interconnect 110 to move with the carriage 104 as it translates in a back and forth direction as indicated by the directional arrow 106. Thus, by its rigid connection to the PHA 108, the fluid conduit interconnect 110 can also be said to be on-axis.

During operation of the printing system 100, as the printhead assembly (PHA) 108 and fluid conduit interconnect 110 translate in a back and forth direction 106 with the carriage 104, the PHA 108 can receive printing fluid via the fluid conduit interconnect 110 and can eject printing fluid from one or multiple printing fluid ejectors onto a print target or print medium 120 to generate text and/or images in response to communications and/or control signals from the printing system controller (not shown). In some example implementations, the carriage 104 can be a stationary carriage that extends across a width of a print medium 120. In such examples, a printhead assembly 108 attached to a stationary carriage 104 may include enough printing fluid ejectors to extend across the width of the print medium 120 along the stationary carriage. In addition, the print medium 120 may be moveable relative to the stationary carriage 104. A print medium 120 or print target can include, for example, suitable cut-sheet or roll-fed media such as paper, card stock, transparencies, fabric, canvas, polyester, and so on. In some examples, as noted above, a print target can also refer to a 3D structure or 3D bed of print material for use in a 3D printing system.

The ability to provide increased volumes of printing fluid to the PHA 108 from an off-axis printing fluid supply 116 through a printing fluid conduit 114 and fluid conduit interconnect 110 enables the use of a single carriage design across various printing systems. The versatility of using off-axis printing fluid supplies helps extend the applicability of such printing systems to a wider range of printing applications, for example, from small, home or personal printing applications, to larger industrial or commercial printing applications that consume more printing fluid. In various printing applications, the ability to remove the PHA 108, and then to service or replace the PHA 108, can be a desirable feature that enables consumers to quickly and efficiently service printing systems while reducing printing downtime.

Figure 4A:
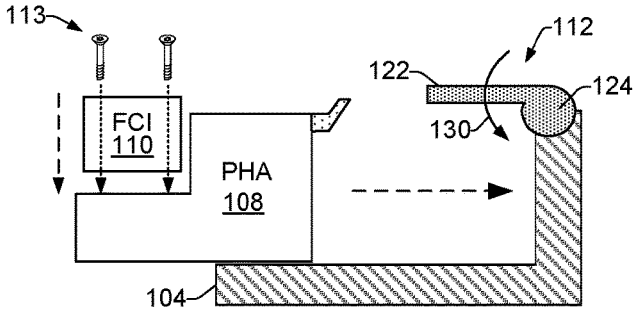
FIG. 4*a* shows a side view of an example arrangement that includes a printing system carriage, a printhead assembly, and a fluid conduit interconnect in an unattached condition.
Figure 4B:
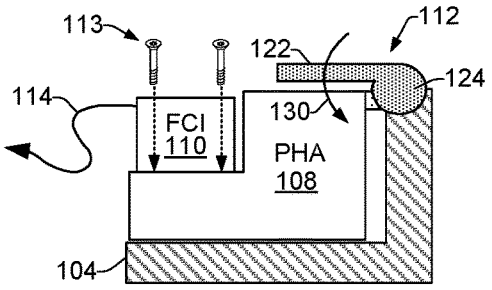
FIG. 4*b* shows a side view of an example arrangement of a carriage, a printhead assembly, and a fluid conduit interconnect in a mounted but unattached condition.
Figure 4C:
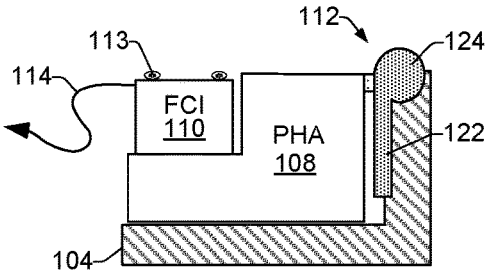
FIG. 4*c* shows a side view of an example arrangement of a carriage, a printhead assembly, and a fluid conduit interconnect in a mounted and attached condition.
Figure 5A:
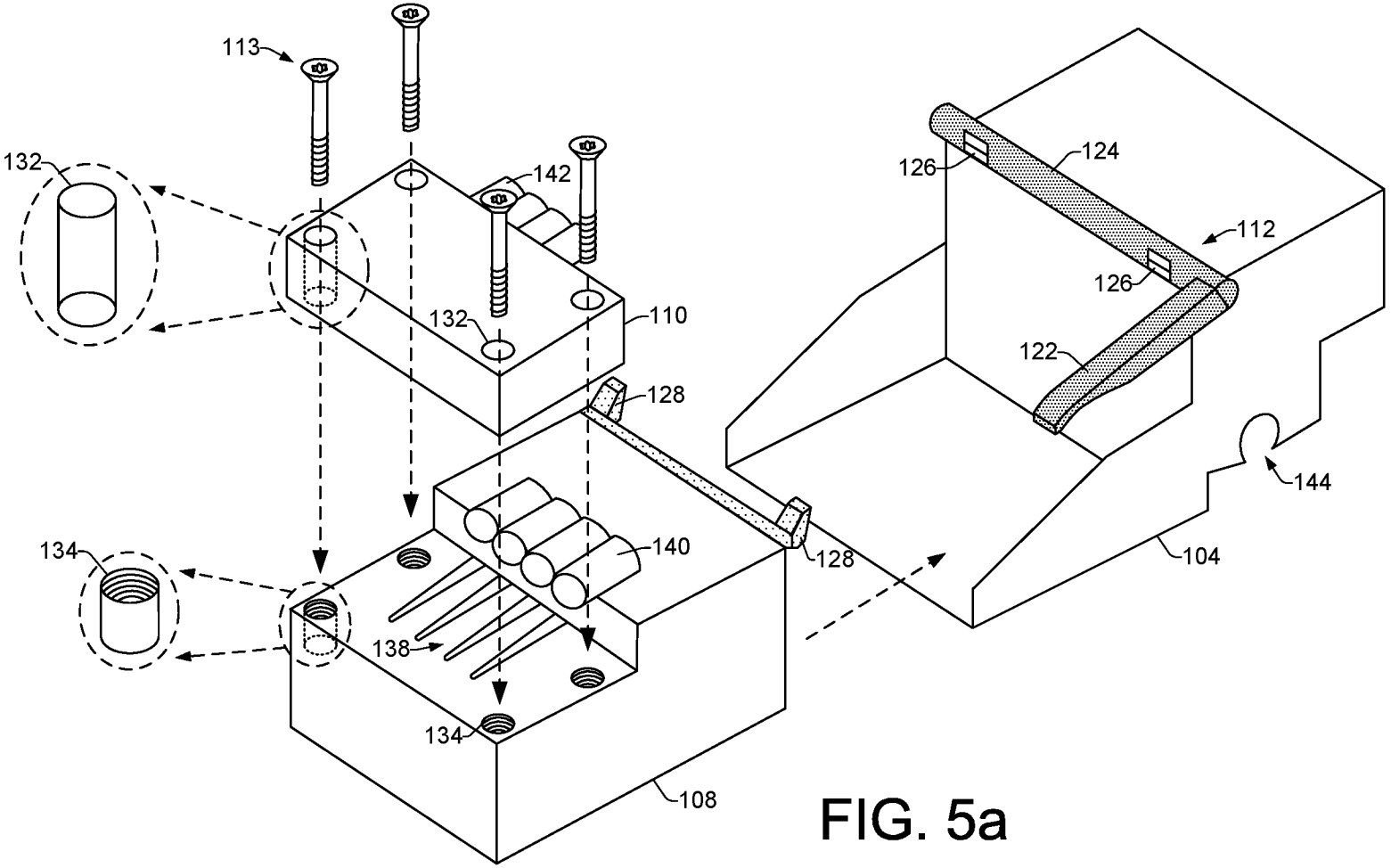
FIG. 5*a* shows a perspective view of an example arrangement that includes a printing system carriage, a printhead assembly, and a fluid conduit interconnect in an unattached condition.

FIGS. 4 and 5 illustrate a general process of mounting and attaching a fluid conduit interconnect 110 and printhead assembly (PHA) 108 to one another and to a printing system carriage 104. FIG. 4*a* shows a side view of a basic block diagram representation of an example arrangement that includes a printing system carriage 104, a PHA 108, and a fluid conduit interconnect 110 in an unattached condition, where the PHA 108 and fluid conduit interconnect 110 are not yet mounted or attached to one another or to the carriage 104. FIG. 5*a* shows a perspective view of the example arrangement of FIG. 4*a* that includes additional details of the printing system carriage 104, the PHA 108, and the fluid conduit interconnect 110, in the unattached condition. In both FIGS. 4*a* and 5*a*, the fluid conduit interconnect 110 is aligned with the PHA 108 in preparation for attachment to the PHA 108 using tool-operable fasteners 113. In addition, the PHA 108 is aligned with the carriage 104, as indicated by dashed direction arrows, in preparation for being mounted and attached to the carriage 104.

Figure 5B:
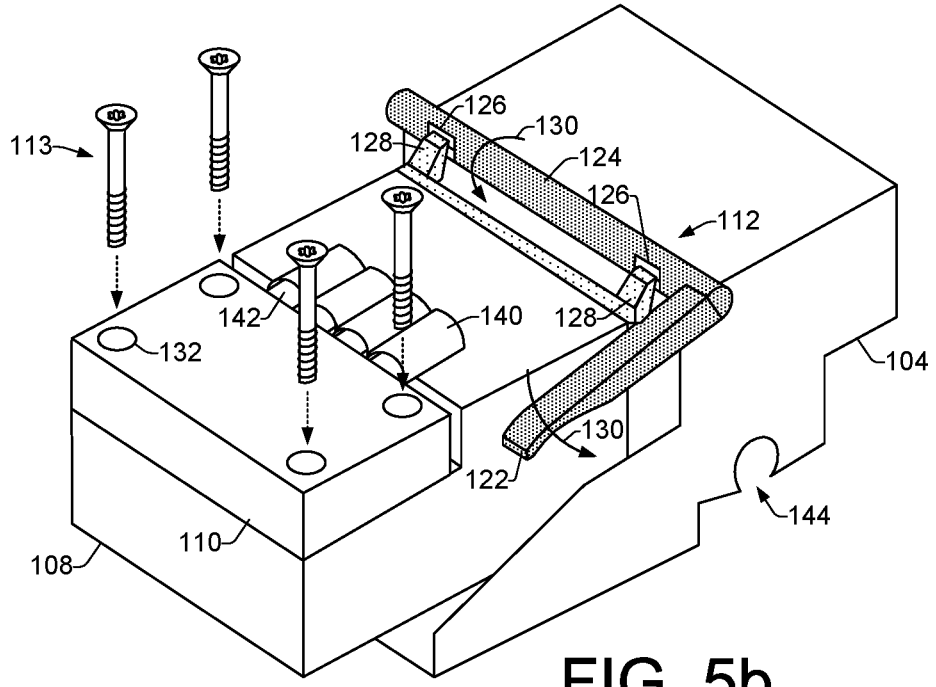
FIG. 5*b* shows a perspective view of an example arrangement of a carriage, a printhead assembly, and a fluid conduit interconnect in a mounted but unattached condition.

FIG. 4*b* shows a side view of an example arrangement of the carriage 104, the PHA 108, and the fluid conduit interconnect 110, in which the PHA 108 and fluid conduit interconnect 110 are mounted to one another and to the carriage 104, but are not yet attached to one another or to the carriage 104. FIG. 5*b* shows a perspective view with additional details of the example arrangement of FIG. 4*b* in which the carriage 104, the PHA 108, and the fluid conduit interconnect 110 are mounted to one another but not yet attached to one another.

Figure 5C:
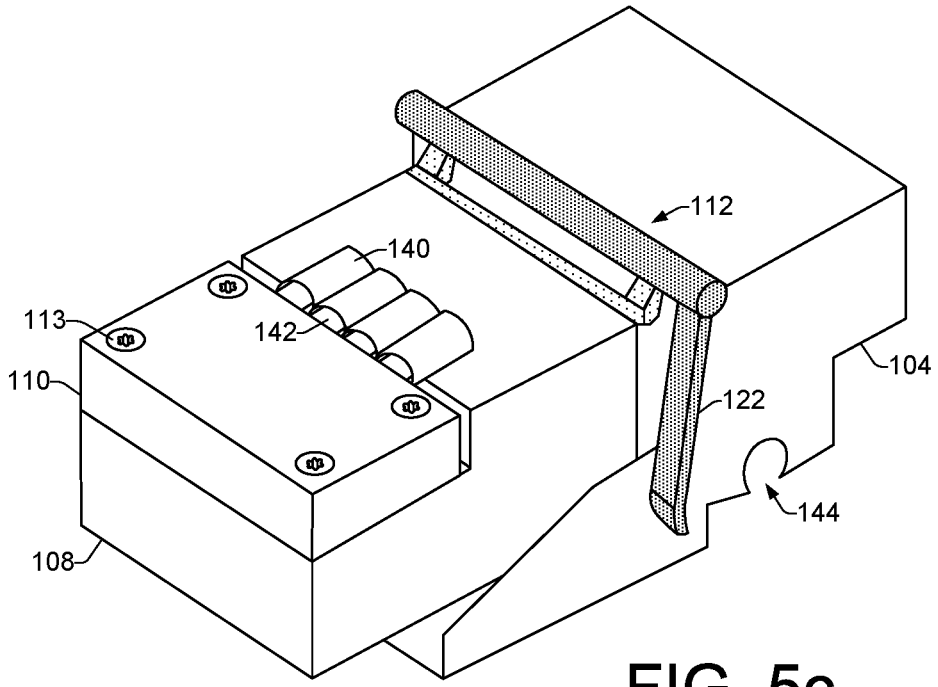
FIG. 5*c* shows a perspective view of an example arrangement of a carriage, a printhead assembly, and a fluid conduit interconnect in a mounted and attached condition.

FIG. 4*c* shows a side view of an example arrangement of the carriage 104, the PHA 108, and the fluid conduit interconnect 110, in which the PHA 108 is mounted and attached to the carriage 104 with hand-operable attachment mechanism 112, and the fluid conduit interconnect 110 is mounted and attached to the PHA 108 with tool-operable fasteners 113. It is noted that in different examples, a greater or lesser number of fasteners 113 can be used to rigidly attach the fluid conduit interconnect 110 to the PHA 108. FIG. 5*c* shows a perspective view with additional details of the example arrangement of FIG. 4*c* in which the PHA 108 is mounted and attached to the carriage 104 with the hand-operable attachment mechanism 112, and the fluid conduit interconnect 110 is mounted and attached to the PHA 108 with the tool-operable fasteners 113.

Referring generally to FIGS. 4 and 5, a quick-release, hand-operable attachment mechanism 112 can comprise a latching mechanism 112 that includes a moveable lever 122 (or other type of moveable member) that can be hand-actuated by a user between an unlocked position (e.g., the position shown in FIGS. 4*b* and 5*b*) and a locked position (e.g., the position shown in FIGS. 4*c* and 5*c*). In some examples, as shown in FIGS. 5*a* and 5*b*, the hand-operable latching mechanism 112 can include a rotatable latch spindle 124 with latch openings 126 for receiving respective engagement members 128 of the printhead assembly (PHA) 108. In some implementations, the engagement members 128 can be in the form of protrusions 128 (e.g. horns) that can be received into the latch openings 126 of the latch spindle 124 upon user actuation of the moveable lever 122, as indicated by circular direction arrows 130 (FIGS. 4*b* and 5*b*). User actuation of the moveable lever 122 rotates the rotatable latch spindle 124 in the direction 130 and puts the dual latching mechanism 112 into the locked position which removably attaches the PHA 108 to the carriage 104.

Although a specific attachment/latching mechanism 112 is shown in FIGS. 1-5 for engaging the engagement members 128 of the PHA 108, it is noted that in other examples, other types of attachment mechanisms for engaging and attaching the PHA 108 to the carriage 104 can be used.

Referring still to FIGS. 4 and 5, fasteners 113 comprise tool-operable fasteners 113 that can be inserted through the fluid conduit interconnect housing to engage the printhead assembly 108. The tool-operable fasteners 113 can be any of a variety of threaded fasteners including screws, bolts, and the like operable using a screwdriver or other torquing mechanism. In some examples, the tool-operable fasteners 113 can be partially threaded such that a portion of the fastener shank is not threaded. As shown in FIGS. 5*a* and 5*b*, the fasteners 113 are partially threaded fasteners that have portions of the shank that are unthreaded toward the head end the fastener. The fasteners 113 are to fit into through-holes 132 on one side or surface of the fluid conduit interconnect 110 and engage the printhead assembly at the opposite side or surface of the fluid conduit interconnect 110.

In examples where the fasteners 113 are partially threaded, the through-holes 132 in the fluid conduit interconnect 110 can have smooth interiors that are not threaded. Thus, there is no threaded engagement between the fasteners 113 and the through-holes 132. In other examples, the through-holes 132 can be threaded, and the fasteners 113 can be fully threaded. In such examples, there can be threaded engagement between the fasteners 113 and the through-holes 132.

As shown in FIG. 5*a*, printhead assembly 108 includes fastening elements 134 disposed in its surface to receive the tool-operable fasteners 113. Fastening elements 134 in the surface of the printhead assembly 108 can include various threaded elements 134 such as, for example, a tapped hole, a threaded bushing, a captive nut, an externally threaded insert, a helical insert, and a mold-in insert. When the fasteners 113 pass through the fluid conduit interconnect 110 through-holes 132, threads of the fasteners 113 can engage and mesh with threads of the fastening elements 134 as the fasteners 113 are rotated (i.e., by a tool). Upon continued rotation of the fasteners 113, the fasteners 113 draw the fluid conduit interconnect 110 closer and closer to the printhead assembly 108 until the fluid conduit interconnect 110 can be rigidly attached to the printhead assembly 108.

As shown in FIG. 5*a*, in some examples the printhead assembly 108 can include alignment grooves 138 to align with alignment ribs (not shown) of the fluid conduit interconnect 110. The alignment ribs can be brought into engagement with the alignment grooves 138 to align fluid connecting elements 140 on the printhead assembly 108 with respective fluid connecting elements 142 on the fluid conduit interconnect 110. In other examples, other types of alignment elements can be provided on the fluid conduit interconnect 110 and printhead assembly 108 to align the fluid connecting elements 140 on the printhead assembly 108 with respective fluid connecting elements 142 on the fluid conduit interconnect 110.

In some examples, the fluid connecting elements 140 and 142 can each include a passageway and a cooperative fluid transfer mechanism associated with the passageway that enables fluid to flow from the fluid conduit interconnect 110 to the PHA 108. In some examples, the fluid transfer mechanism can include a needle-septum interface where a hollow needle in a passageway of the fluid connecting element 140, for example, can engage with a respective septum of the corresponding fluid connecting element 142. In other examples, a hollow needle can be provided in the fluid connecting element 142, and a septum can be provided in the fluid connecting element 140. Although four fluid connecting elements 140/142 are depicted in the described examples, it is noted that in other examples, a different number of fluid connecting elements can be provided.

As shown in FIGS. 5*a*, 5*b*, and 5*c*, the carriage 104 includes a printing system shaft receptacle 144 that can be mounted onto a shaft (not shown) of the printing system 100 to allow the carriage 104 to be moveable along the shaft during operation of the printing system 100.

Figure 6A:
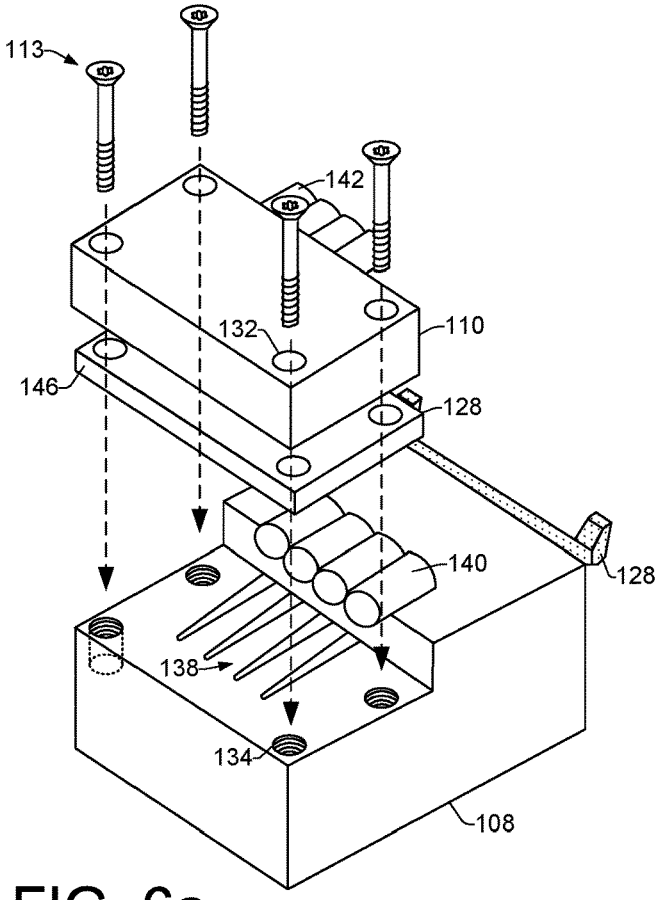
FIGS. 6*a* and 6*b* show an example of a fluid conduit interconnect and printhead assembly being attached using threaded, tool-operable fasteners through an interface.
Figure 6B:
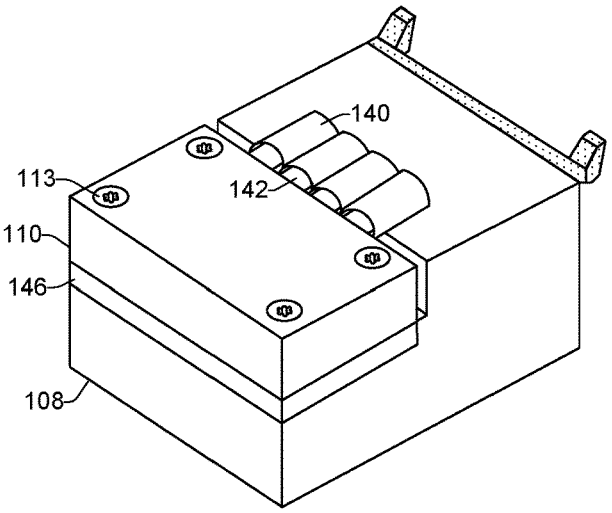

In some examples, an interface can be included between the fluid conduit interconnect 110 and the printhead assembly 108 to facilitate a rigid and semi-permanent attachment. FIGS. 6*a* and 6*b* show a fluid conduit interconnect 110 and printhead assembly 108 being attached using threaded, tool-operable fasteners 113, through an interface 146. An interface 146 may comprise an interface bracket or plate or other suitable interface mechanism that enables a rigid attachment of the fluid conduit interconnect 110 to the printhead assembly 108 using the threaded, tool-operable fasteners 113. In some examples, additional fasteners (not shown) can be used to separately attach the fluid conduit interconnect 110 to the interface 146, and attach the printhead assembly 108 to the interface 146.

Figure 7:
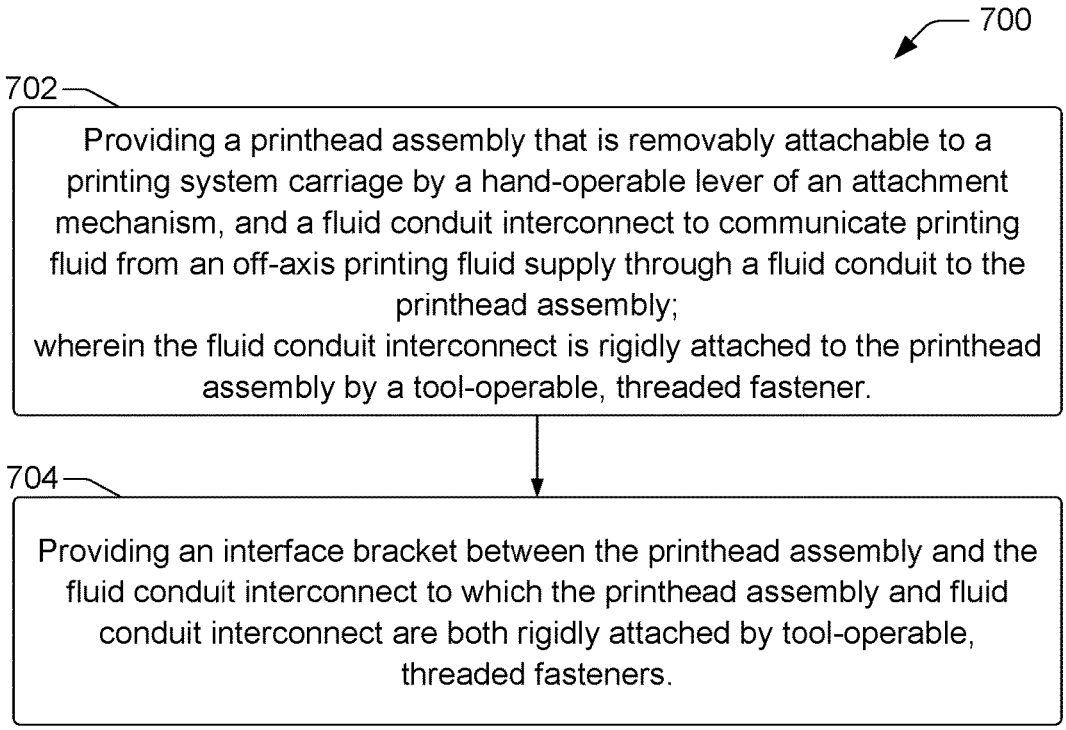
FIG. 7 shows a flow diagram of an example process of forming an example arrangement of components of a fluid supply assembly within a printing system.

FIG. 7 is a flow diagram of an example process 700 of forming an example arrangement of components of a fluid supply assembly within a printing system.

The process 700 provides (702) a printhead assembly 108 that is removably attachable to a printing system carriage 104 by a hand-operable lever 122 of an attachment mechanism 112, and a fluid conduit interconnect 110 to communicate printing fluid from an off-axis printing fluid supply 116 through a fluid conduit 114 to the printhead assembly 108. The fluid conduit interconnect 110 is rigidly attached to the printhead assembly 108 by a tool-operable, threaded fastener 113.

The process 700 also provides (704) an interface bracket 146 between the printhead assembly 108 and the fluid conduit interconnect 110 to which the printhead assembly 108 and fluid conduit interconnect 110 are both rigidly attached by tool-operable, threaded fasteners 113.

What is claimed is:

1. A fluid supply assembly comprising:

a printhead assembly;

a carriage comprising a quick-release, hand-operable attachment mechanism to removably attach the printhead assembly to the carriage; and, a fluid conduit interconnect directly and rigidly attached to the printhead assembly by a tool-operable fastener, the fluid conduit interconnect to connect to a fluid conduit to communicate printing fluid from an off-axis printing fluid supply to the printhead assembly.

2. A fluid supply assembly as in claim 1, wherein the printhead assembly comprises a fastening element to receive the tool-operable fastener.

3. A fluid supply assembly as in claim 2, wherein the fastening element comprises a threaded element selected from the group consisting of a tapped hole, a threaded bushing, a captive nut, an externally threaded insert, a helical insert, and a mold-in insert.

4. A fluid supply assembly as in claim 2, wherein the fluid conduit interconnect comprises a through hole to enable the tool-operable fastener to pass through the fluid conduit interconnect to engage the fastening element of the printhead assembly.

5. A fluid supply assembly as in claim 1, wherein the hand-operable attachment mechanism is to attach the printhead assembly to the carriage or detach the printhead assembly from the carriage in a single user action.

6. A fluid supply assembly as in claim 1, wherein the tool-operable fastener comprises a threaded fastener.

7. A fluid supply assembly as in claim 1, wherein the fluid conduit comprises flexible ribbon tubing having multiple fluid paths for interconnecting multiple off-axis fluid supplies through the fluid conduit interconnect to the printhead assembly.

8. A fluid supply assembly as in claim 1, wherein the printhead assembly comprises engagement elements to attach to the hand-operable attachment mechanism.

9. A fluid supply assembly as in claim 8, wherein the hand-operable attachment mechanism comprises:

a rotatable latch spindle having latch openings to receive the engagement elements of the printhead assembly; and, a hand-operable lever, wherein the single user action comprises movement of the hand-operable lever to rotate the rotatable latch spindle to cause the latch openings to receive the engagement elements of the printhead assembly.

10. A fluid supply assembly as in claim 9, wherein the engagement elements comprise protrusions emanating from the printhead assembly and oriented to enter the latch openings upon rotation of the rotatable latch spindle.

11. A fluid supply assembly as in claim 1, wherein the printhead assembly comprises a printing fluid ejector, and wherein the fluid conduit interconnect is rigidly attached directly to the printhead assembly by the tool-operable fastener.

12. A fluid supply assembly as in claim 1, wherein the carriage was initially designed for use with an on-axis fluid supply.

13. A fluid supply assembly as in claim 1, wherein the carriage is a stationary carriage, and the printhead assembly comprises printing fluid ejectors that extend across a width of a print medium.

14. A printing system comprising:

an off-axis printing fluid supply;

a printhead assembly;

a carriage comprising a hand-operable attachment mechanism moveable between a locked and unlocked position, the locked position to secure the printhead assembly to the carriage, and the unlocked position to release the printhead assembly from the carriage; and, a fluid conduit interconnect to provide printing fluid from the off-axis printing fluid supply to the printhead assembly through a fluid conduit, the fluid conduit interconnect directly and rigidly attached to the printhead assembly by a threaded fastener.

15. A printing system as in claim 14, wherein the printhead assembly comprises:

an engagement mechanism to engage a latch opening in the attachment mechanism upon user actuation of the attachment mechanism; and, a fastening element to receive the threaded fastener.

16. A printing system as in claim 14, wherein the printhead assembly and fluid conduit interconnect comprise a needle-septum fluid transfer mechanism to enable transfer of printing fluid when the attachment mechanism is in the locked position.

17. A printing system as in claim 14, wherein the printhead assembly comprises a printing fluid ejector, and wherein the fluid conduit interconnect is rigidly attached directly to the printhead assembly by the threaded fastener.

18. A method comprising:

providing a printhead assembly that is removably attachable to a printing system carriage by a hand-operable lever of an attachment mechanism, and a fluid conduit interconnect to communicate printing fluid from an off-axis printing fluid supply through a fluid conduit to the printhead assembly;

wherein the fluid conduit interconnect is directly and rigidly attached to the printhead assembly by a tool-operable, threaded fastener.

19. The method of claim 18, further comprising:

providing an interface bracket between the printhead assembly and the fluid conduit interconnect to which the printhead assembly and fluid conduit interconnect are both rigidly attached by tool-operable, threaded fasteners.

20. The method of claim 18, further comprising using the printhead assembly in a printing system carriage initially designed for use with an on-axis fluid supply.

* * * * *